US008493291B2

(12) United States Patent
Nam et al.

(10) Patent No.: US 8,493,291 B2
(45) Date of Patent: Jul. 23, 2013

(54) APPARATUS AND METHOD FOR CONTROLLING DRIVING OF LIQUID CRYSTAL DISPLAY DEVICE

(75) Inventors: Hyun-Taek Nam, Daegu (KR); Han-Yung Jung, Daegu (KR)

(73) Assignee: LG Display Co., Ltd., Seoul (KR)

( * ) Notice: Subject to any disclaimer, the term of this patent is extended or adjusted under 35 U.S.C. 154(b) by 1109 days.

(21) Appl. No.: 12/314,419

(22) Filed: Dec. 10, 2008

(65) Prior Publication Data

US 2009/0195529 A1 Aug. 6, 2009

(30) Foreign Application Priority Data

Dec. 11, 2007 (KR) ..... 10-2007-0128490

(51) Int. Cl.
*G09G 3/18* (2006.01)
*G09G 3/36* (2006.01)
*G09G 5/00* (2006.01)

(52) U.S. Cl.
USPC ..... 345/54; 345/213; 345/99

(58) Field of Classification Search
USPC ..... 345/213, 54
See application file for complete search history.

(56) References Cited

U.S. PATENT DOCUMENTS

| | | | | |
|---|---|---|---|---|
| 6,211,854 | B1 * | 4/2001 | Fujiyoshi | 345/10 |
| 2001/0004253 | A1 * | 6/2001 | Fukutoku et al. | 345/96 |
| 2002/0175907 | A1 * | 11/2002 | Sekiya et al. | 345/211 |
| 2005/0258780 | A1 * | 11/2005 | Chen | 315/291 |
| 2008/0001890 | A1 * | 1/2008 | Song et al. | 345/96 |
| 2008/0030522 | A1 * | 2/2008 | Dorbie et al. | 345/614 |
| 2008/0291222 | A1 * | 11/2008 | Hou et al. | 345/690 |

* cited by examiner

*Primary Examiner* — Alexander S Beck
*Assistant Examiner* — Mihir Rayan
(74) *Attorney, Agent, or Firm* — Morgan, Lewis & Bockius LLP

(57) ABSTRACT

The present invention involves a technique of recognizing a demand for displaying a shutdown pattern when driving a liquid crystal panel in an inversion method and converting the inversion method into another inversion method causing no horizontal crosstalk. The present invention is achieved by providing an apparatus for controlling driving of a liquid crystal display device, comprising: a timing controller for processing input RGB data by a certain inversion method to supply the data to a data driver and, upon inputting of RGB data of a shutdown pattern, converting the RGB data by an inversion driving method causing no crosstalk to supply the data; a gate driver for outputting gate signals to each gate line of a liquid crystal panel in response to a gate signal control signal; and a data driver for supplying data voltages to each data line of the liquid crystal panel in response to a data signal control signal.

5 Claims, 3 Drawing Sheets

| | | | | | |
|---|---|---|---|---|---|
| + | + | − | − | + | + |
| + | + | − | − | + | + |
| − | − | + | + | − | − |
| − | − | + | + | − | − |
| + | + | − | − | + | + |
| + | + | − | − | + | + |

Frame N

| | | | | | |
|---|---|---|---|---|---|
| − | − | + | + | − | − |
| − | − | + | + | − | − |
| + | + | − | − | + | + |
| + | + | − | − | + | + |
| − | − | + | + | − | − |
| − | − | + | + | − | − |

Frame N+1

APPARATUS AND METHOD FOR CONTROLLING DRIVING OF LIQUID CRYSTAL DISPLAY DEVICE

BACKGROUND OF THE INVENTION

1. Field of the Invention

The present invention relates to a driving technique of a liquid crystal display device, and more particularly, to an apparatus and method for controlling driving of a liquid crystal display device, which allows to recognize a situation in which a shutdown crosstalk noise occurs when driving a liquid crystal panel in a certain inversion method and to switch to another inversion driving method for avoiding the noise.

2. Discussion of the Related Art

As IT (Information Technology) develops recently, a display device plays an important role as a medium for displaying visual information. In order to be spotlighted in the future, the display device has to meet the following conditions such as a low power consumption, a thin thickness, a light weight, a high picture quality and so on.

An LCD device is a typical display device of flat panel display devices and operates to display images by using an optical anisotropy of a liquid crystal. The LCD device has advantages in that it is thin, small, low in power consumption, high in picture quality and so on, accordingly being developed as a main product of the flat panel display devices for replacing a cathode-ray tube (CRT).

Generally, the LCD device serves to display desired images by supplying image information to pixels arranged in a matrix shape, respectively, and adjusting a light transparency of the pixels. Thus, the LCD device includes a liquid crystal panel on which each pixel which is a minimum unit for implementing images is arranged in an active matrix shape, and a driving unit for driving the liquid crystal panel. Further, because the LCD device cannot emit light by itself, the LCD device is provided with a backlight unit for supplying light thereto.

Driving methods for the liquid crystal panel include line inversion, column inversion, dot inversion and so forth in accordance with the phase of pixel (or data) signals applied to data lines. The line inversion method is a method that applies the pixel signals to each of the data lines after inverting the phase of the pixel signal for each line. The column inversion method is a method that applies the pixel signals to each of the data lines after inverting the phase of the pixel signal for each column. The dot inversion method is a method that applies the pixel signals to each of the data lines after inverting the phase of the pixel signal for each column and line.

Besides, there is a square inversion method. As shown in FIG. 1, this method is a method that supplies a positive (+) pixel signal to two consecutive liquid crystal pixels and supplies a negative (−) video signal to the next two consecutive liquid crystal pixels. As a result, the square inversion method is a method in which four liquid crystal pixels are driven as one group.

The reason why liquid crystal is driven in the inversion method as above is to prevent deterioration caused by the continuous alignment of liquid crystal only in one direction. That is, the inversion method is to align liquid crystal at the right once and align it at the opposite direction (left) next time by supplying a positive video signal and a negative video signal in an alternate manner.

Generally, the dot inversion method is known to realize better picture quality because this method produces less crosstalk compared with the line inversion method or column inversion method. This is because pixel voltages having different phases are applied to pixel electrodes adjacent to each other.

The displaying of an image by turning it on and off in units of one pixel when displaying the image through an activated window in a liquid crystal display deice is referred to as a shutdown pattern. FIGS. 2(*a*)-(*c*) are views for explaining the shutdown pattern.

FIG. 2(*a*) shows that, in displaying a shutdown pattern in a certain region (e.g., center region) of the wallpaper screen, when a blue-green shutdown pattern is displayed in two rectangular regions in an up-and-down direction and a skin color shutdown pattern is displayed at a center part between the rectangular regions, a horizontal crosstalk occurs in the left and right directions of the shutdown pattern displayed at the center part on the wallpaper screen. FIG. 2(*b*) shows the polarities of pixels of the shutdown pattern at the upper side among the upper and lower side shutdown patterns and the polarities of pixels of the shutdown pattern at the center part. FIG. 2(*c*) shows the waveforms of the pixels of the first horizontal lines of the two shutdown patterns.

The shutdown pattern at the upper side is driven by a horizontal one dot and vertical two dot inversion scheme. Regarding the pixels of the first horizontal line thereof, it can be seen that, as shown in FIG. 2(*b*), in odd-numbered horizontal lines, the odd-numbered pixels are turned on but the gray scale values of RGB subpixel data thereof are '0', '127', and '127', while the even-numbered pixels are turned off and the gray scale values of RGB subpixel data thereof are all '0'. Accordingly, as shown in FIG. 2(*c*), the gray scale value of −127 of G subpixel data and the gray scale value of +127 of B subpixel data are balanced, thus there occurs no shift of a common voltage. Therefore, no crosstalk appears around (at the left and right of) the shutdown pattern at the upper side.

The shutdown pattern at the center part is driven by the horizontal one dot and vertical two dot inversion scheme. Regarding the pixels thereof, it can be seen that, as shown in FIG. 2(*b*), in odd-numbered horizontal lines, the gray scale values of odd-numbered RGB subpixel data are all '127', while the even-numbered pixels are turned off and the gray scale values of RGB subpixel data thereof are all '0'. By the way, it can be seen that, as shown in FIG. 2(*c*), among the subpixel data of the turned-on pixels, the gray scale values of the R and B subpixel-data are +127 and the gray scale value of the G subpixel data is −127. In other words, among the RGB subpixel data of the turned-on pixels, the two RB subpixel data are positive (+) and the one G subpixel data is negative (−), thereby causing a shift of the common voltage Vcom in the positive polarity direction.

In the even-numbered horizontal lines, it can be seen that the gray scale values of the RGB subpixel data constituting the odd-numbered pixels are all '0' and turned off, the gray scale values of the RB subpixel data among the RGB subpixel data constituting the even-numbered pixels are −127, and the gray scale value of the G subpixel data is +127. In other words, regarding the polarities of the RGB subpixel data of the turned-on pixels, the two RB subpixel data are negative (−) and the one G subpixel data is positive (+), thereby causing a shift of the common voltage Vcom in the negative polarity direction.

In this way, a phenomenon that the common voltage Vcom is shifted in the positive or negative polarity direction in each horizontal line, and hence, as shown in FIG. 2(*a*), a horizontal crosstalk occurs in the left and right directions of the shutdown pattern.

Consequently, in the prior art inversion driving technique of a liquid crystal display device as in the above description, when a shutdown pattern is displayed when driving a liquid crystal panel in a predetermined inversion method (for example, horizontal 1 dot and vertical two dot, horizontal one dot and vertical one dot, etc.), a horizontal crosstalk occurs due to a shift of a common voltage.

SUMMARY OF THE INVENTION

The present invention involves a technique of recognizing a demand for displaying a shutdown pattern when driving a liquid crystal panel in an inversion method and converting the inversion method into another inversion method causing no horizontal crosstalk. The present invention is achieved by providing an apparatus for controlling driving of a liquid crystal display device, comprising: a timing controller for processing input RGB data by a certain inversion method to supply the data to a data driver and, upon inputting of RGB data of a shutdown pattern, converting the RGB data by an inversion driving method causing no crosstalk to supply the data; a gate driver for outputting gate signals to each gate line of a liquid crystal panel in response to a gate signal control signal; and a data driver for supplying data voltages to each data line of the liquid crystal panel in response to a data signal control signal.

BRIEF DESCRIPTION OF THE DRAWINGS

The present invention will become more fully understood from the detailed description given herein below and the accompanying drawings, which are given by illustration only, and thus are not limitative of the present invention, and wherein:

FIG. 2(*b*) is a polarity table of pixel signals causing crosstalk;

FIG. 2(*c*) is an illustrative view showing a shift of a common voltage by a shutdown pattern;

DETAILED DESCRIPTION OF THE PREFERRED EMBODIMENTS

Hereinafter, a preferred embodiment of the present invention will be described below with reference to the accompanying drawings.

Figure 3:
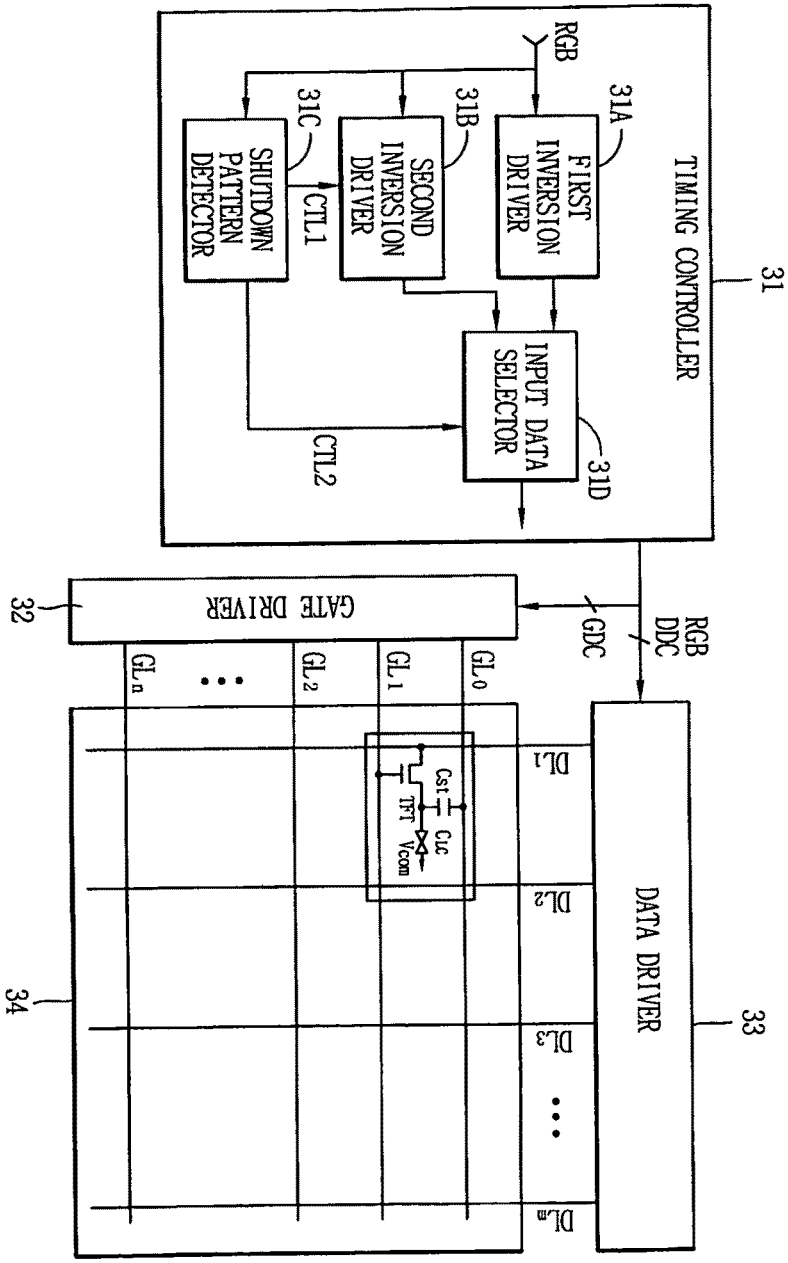
FIG. 3 is a block diagram of an apparatus for controlling driving of a liquid crystal display device according to the present invention.

FIG. 3 is a block diagram showing one embodiment of an apparatus for controlling driving of a liquid crystal display device according to the present invention. As shown therein, the apparatus comprises: a timing controller for processing input RGB data by a certain inversion method to supply the data to a data driver 33 and, if it is judged that RGB data of a shutdown pattern is inputted as a result of checking the inputting of RGB data of a shutdown pattern, converting the RGB data by an inversion driving method causing no crosstalk to supply the data; a gate driver for outputting gate signals to each gate line GL1~GLn of a liquid crystal panel 34 in response to a gate signal control signal supplied from the timing controller 31; a data driver 33 for supplying data voltages to each data line DL1~DLm of the liquid crystal panel 34 in response to a data signal control signal supplied from the timing controller 31; and the liquid crystal panel 34 having liquid crystal cells driven by the gate signals and pixel signals in a matrix form to display images.

The timing controller 31 comprises a first inversion driver 31A for processing and outputting RGB data supplied from the system by a vertical two dot and horizontal 1 dot inversion method or a vertical one dot and horizontal one dot inversion method; a second inversion driver 31B driven by a drive control signal CTL1 to be described later, for converting and outputting the RGB data by an inversion method causing no horizontal crosstalk; a shutdown pattern detector 31C for outputting the drive control signal CTL1 to the second inversion driver 31B and a switching control signal CTL2 to an input data selector 31D if the current input frame is judged to be a shutdown pattern frame by checking the RGB data; and the input data selector 31D for selecting and outputting the RGB data outputted from the first inversion driver 31A at normal times and selecting and outputting the RGB data outputted from the second inversion driver 31B by the switching control signal CTL2 upon inputting of RGB data of a shutdown pattern.

Figure 4:
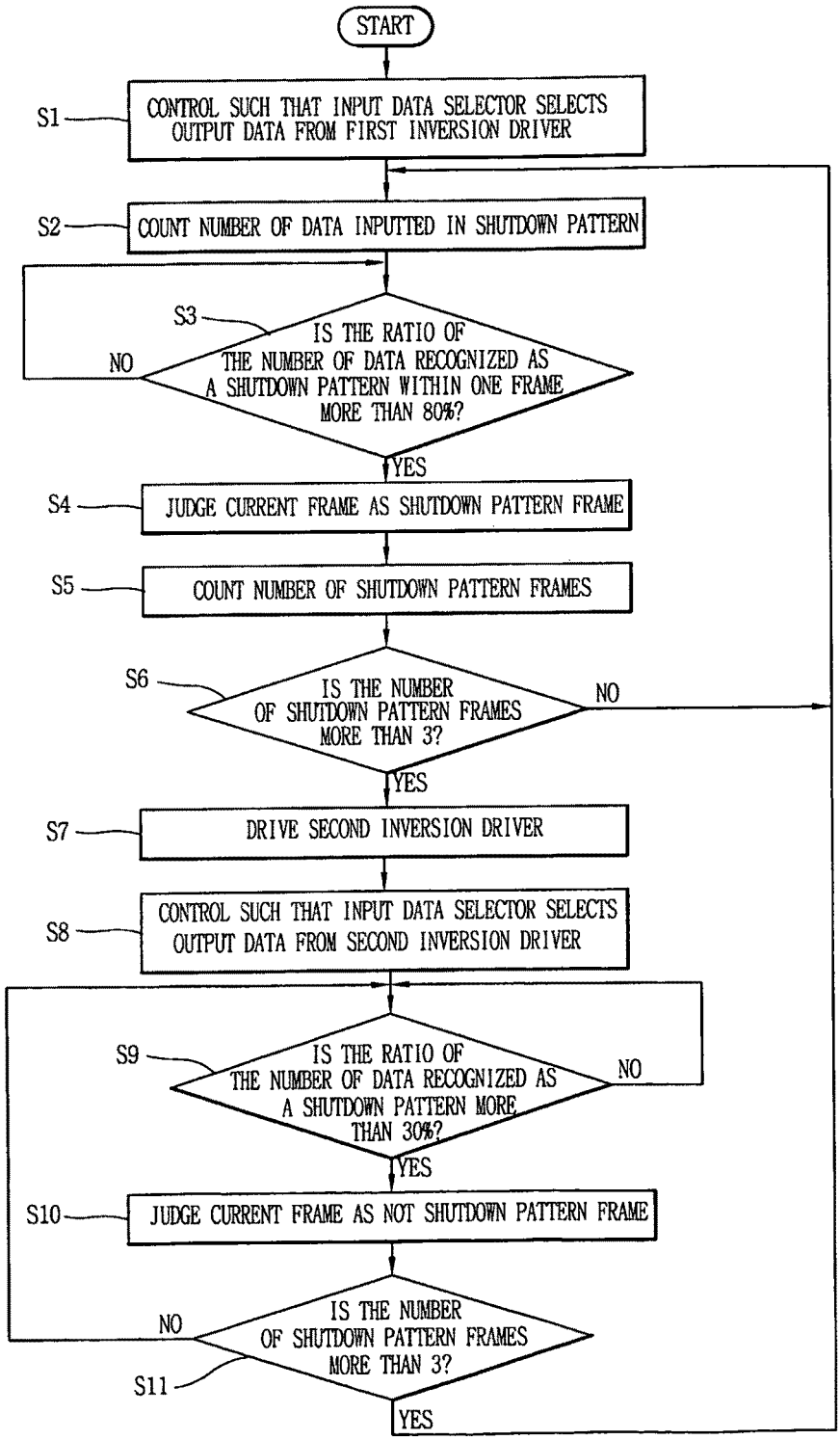
FIG. 4 is a control flow chart of a method for controlling driving of a liquid crystal display device according to the present invention.

The operation of the present invention thus constructed will be described in detail below with reference to the attached FIGS. 2 and 4.

The timing controller 31 outputs a gate control signal GDC for controlling the gate driver 32 and a data control signal DDC for controlling the data driver 33 by using vertical/horizontal synchronization signals Vsync and Hsync and a clock signal CLK supplied from the system. Further, the timing controller 31 samples digital pixel data (RGB data) inputted from the system and re-aligns the data to supply it to the data driver 33.

The gate control signal GDC includes a gate start pulse GSP, a gate shift clock GSC, and a gate output enable signal GOE. The data control signal DDC includes a source start pulse GSP, a source shift clock SSC, a source output enable signal SOE, and a polarity signal POL.

The gate driver 32 sequentially supplies gate signals to the gate lines GL1~GLn in response to a gate control signal GDC inputted from the timing controller 3, and thus the corresponding thin film transistors TFTs on horizontal lines are turned on. Accordingly, pixel signals supplied via the data lines DL1~DLm are stored their respective storage capacitors Cst through the thin film transistors TFTs.

More specifically, the gate driver 32 generates a shift pulse by shifting the gate start pulse GSP in accordance with the gate shift clock GSC. In response to the shift clock, the gate driver 32 supplies a gate signal comprised of gate on/off intervals (signals) to the corresponding gate line GL for each horizontal period. In this case, the gate driver 32 supplies a gate-on signal only during an enable period in response to the gate-out enable signal GOE, and supplies a gate-off signal (gate low signal) during the other periods.

The data driver 33 converts the RGB data into analog pixel signals (data signals or data voltages) corresponding to gray scale values in response to the data control signal DDC inputted from the timing controller 31, and supplies the converted pixel signals to the data lines DL1~DLm on the liquid crystal panel 34.

More specifically, the data driver 33 generates a sampling signal by shifting a source start pulse SSP in accordance with a source shift clock SSC. Next, the data driver 33 sequentially receives and latches the RGB data on a predetermined unit basis in response to the sampling signal. The data driver 33 then converts the latched RGB data corresponding to one line into analog pixel signals and applies the analog pixel signals to the data lines DL1~DLm.

The liquid crystal panel 34 includes a plurality of liquid crystal cells $C_{LC}$ arranged in a matrix and a thin film transistor TFT formed at each of the crossings between the data lines DL1~DLm and the gate lines GL1~GLn.

The thin film transistor TFT is turned on when a gate-on signal from the gate line GL is supplied, to thereby supply a pixel signal from the data line DL to the liquid crystal cell $C_{LC}$. Further, the thin film transistor TFT is turned off when a gate-off signal from the gate line GL is supplied, to thereby keep a pixel signal charged in the liquid crystal cell $C_{LC}$.

The liquid crystal cell $C_{LC}$ includes a common electrode, a pixel electrode connected to the thin film transistor TFT, and a liquid crystal between the electrodes. Furthermore, the liquid crystal cell $C_{LC}$ further includes a storage capacitor Cst so as to stably keep the charged pixel signal until the next pixel signal is charged. The storage capacitor Cst is formed between the pixel electrode and the gate line at the previous stage.

The light transmittance is controlled by changing the alignment state of the liquid crystal having a dielectric anisotropy in accordance with the pixel signal charged through the thin film transistor TFT. Thus, gray scale levels are achieved by controlling light transmittance.

When processing digital pixel data (RGB data) supplied from the system by a certain inversion method and supplying the data to the data driver 33, if it is judges that pixel data of a shutdown pattern is inputted as a result of checking the inputting of pixel data of a shutdown pattern, the timing controller 31 processes and supplies the RGB data by an inversion driving method causing no crosstalk. The processing procedure will be described in more detail below.

At normal times, the first inversion driver 31A processes and outputs RGB data supplied from the system by a certain inversion method, for example, a vertical two dot and horizontal one dot (V2 H1) inversion method or a vertical one dot and horizontal one dot (V1 H1) inversion method.

Next, the input data selector 31D selects the RGB data outputted from the first inversion driver 31A by the inversion driving method and supplies the data to the data driver 33 under control of the switching control signal CTL2 outputted from the shutdown pattern detector 31C (S1).

Figures 1, 2:
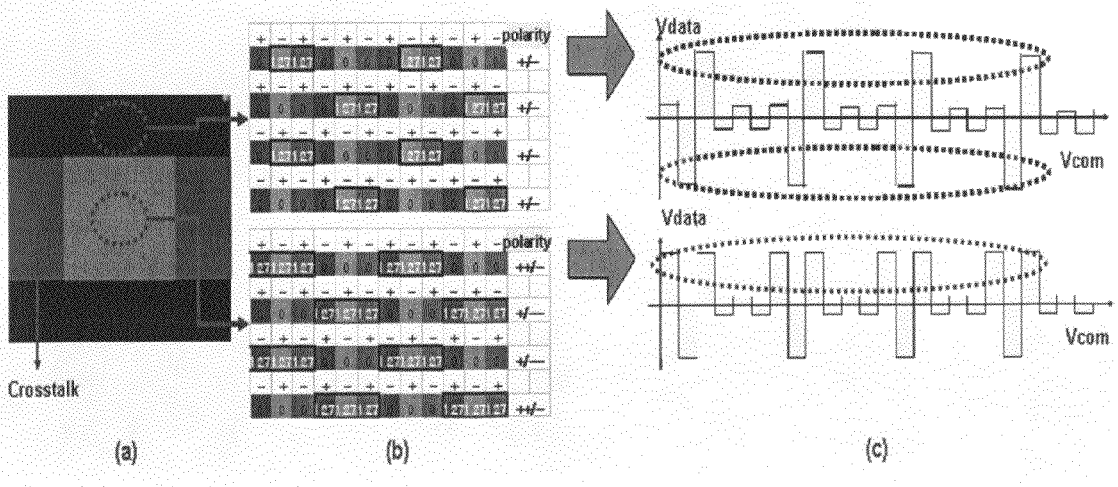
FIG. 1 is a polarity table of pixel signals for explaining a square inversion method.
FIG. 2(*a*) is an illustrative view showing the occurrence position of a crosstalk.

In this state, when the displaying of the shutdown pattern is required, the RGB data inputted from the system have on/off values alternately in units of one pixel (RGB subpixel) as shown in FIG. 2(*b*). For reference, if the gray scale values of the RGB data range from 255 to 48, they are judged as turned-on data values, and if the gray scale values of the RGB data range from 15 to 0, they are judged as turned-off data values.

Therefore, by checking whether at least one data among the RGB data constituting one pixel has an on/off type data value, it is possible to judge whether the current input RGB data is data of a shutdown pattern or not.

The shutdown pattern detector 31C checks whether at least one data, for example, R data, among the RGB data, is inputted in a shutdown pattern (on/off type), and if it is judged that the R data is inputted in that pattern, counts the number of shutdown patterns for the R data within one frame by using a shutdown pattern counter (S2).

After counting the number of shutdown patterns for the R data within one frame, it is checked whether the ratio of the number of shutdown patterns to all the R data within the frame is more than a predetermined value (e.g., 80%), and if the ratio is more than the predetermined value, the display pattern of the current frame is judged as a shutdown pattern (S3, S4).

Afterwards, the shutdown pattern frames as above are counted by using a frame counter to check during how many consecutive frames such a shutdown pattern is repeated (S5, S6).

As a result of checking, if it is judged that there are more than a predetermined number of consecutive frames (e.g., three frames) having a. shutdown pattern, the shutdown pattern detector 31C outputs a drive control signal CTL1 to the second inversion driver 31B, thereby converting input RGB data by an inversion method (e.g., square inversion method, horizontal two dot inversion method, etc.) causing no horizontal crosstalk (S7).

Furthermore, the shutdown pattern detector 31C outputs the switching control signal CTL2 to the input data selector 31D, thereby allowing the second inversion driver 31B to select and output data processed by the square inversion method as in FIG. 1 or data processed by the horizontal second dot inversion method.

For reference, the reason why the shutdown pattern detector 31C allows to output the data processed by the square inversion method or the data processed by the horizontal two dot inversion method after judging that there are more than a predetermined number of consecutive frames having the shutdown pattern is to prevent the system from being unstably operated, reacting too sensitively to the shutdown pattern.

For instance, if RGB data is converted by a square inversion method not when there are three consecutive frames having the shutdown pattern, but when there is one or two consecutive frames having the shutdown pattern, there may occur a problem that an internet ad window being instantaneously displayed in white is recognized wrongly as a shutdown pattern frame and operated.

By the above procedure, the current inversion driving mode is set to the square inversion method or the horizontal two dot inversion mode, and then if it is judged that R data is inputted in the shutdown pattern as a result of checking whether R data is inputted in the shutdown pattern, it is checked whether the ratio of the number of shutdown patterns to all the R data is less than a predetermined value (e.g., 30%). If the ratio is less than a predetermined value, it is judged that the display pattern of the current frame is not a shutdown pattern (S9, S10).

Then, it is checked whether there are a predetermined number of consecutive frames (e.g., three frames) having no shutdown pattern, the drive control signal CTL1 is outputted to the second inversion driver 31B to stop the driving thereof, and the switching control signal CTL2 is outputted to the input data selector 31D, thereby allowing the first inversion driver 31A to select and output data processed by the vertical two dot and horizontal one dot inversion method or the vertical one dot and horizontal one-dot inversion method (S11).

As described above, in the present invention, when processing RGB data supplied from the outside by a certain inversion method and supplying the data to the data driver, the RGB data is converted and supplied by an inversion driving method causing no crosstalk upon inputting of pixel data of a shutdown pattern, thereby preventing the occurrence of crosstalk noise around the area where the shutdown pattern is displayed.

What is claimed is:

1. An apparatus for controlling driving of a liquid crystal display device, comprising:

a timing controller configured to:

process input RGB data by a certain inversion method to supply the data to a data driver; and upon inputting of RGB data of a shutdown pattern, convert the RGB data by an inversion driving method causing no crosstalk to supply the data;

a gate driver configured to output gate signals to each gate line of a liquid crystal panel in response to a gate signal control signal; and a data driver configured to supply data voltages to each data line of the liquid crystal panel in response to a data signal control signal, wherein the timing controller comprises:

a shutdown pattern detector configured to check whether at least one data among the RGB data is inputted in a shutdown pattern, counts the number of data inputted in the shutdown pattern, and if the ratio of the number of data inputted in the shutdown pattern within one frame is more than 80% and there are more than three consecutive frames having the shutdown pattern, judge the current frame as a shutdown pattern frame, wherein the shutdown pattern detector is further configured to:

output a control signal to allow the input data selector to select and output again the RGB data outputted from a first inversion driver when the ratio of the number of shutdown patterns of the current frame, which has been judged to be the shutdown pattern frame, is judged to be less than 30%, judge that the current frame is a shutdown pattern when a gray scale value of the outputted RGB data is in the range from 255 to 48, and judge that the current frame is not a shutdown pattern when the gray scale value of the RGB data is in the range from 15 to 0.

2. The apparatus of claim 1, wherein the timing controller comprises:

the first inversion driver for processing and outputting input RGB data by a vertical two dot and horizontal 1 dot inversion method or a vertical one dot and horizontal one dot inversion method;

a second inversion driver driven by a drive control signal. for converting and outputting the RGB data by an inversion method causing no horizontal crosstalk; and the input data selector for selecting and outputting the RGB data outputted from the first inversion driver at normal times and selecting and outputting the RGB data outputted from the second inversion driver by a switching control signal upon inputting of RGB data of a shutdown pattern.

3. The apparatus of claim 1, wherein the second inversion driver selects a square inversion method or horizontal two dot inversion method as an inversion method causing no horizontal crosstalk, and converts the input RGB data by the selected inversion method.

4. A method for controlling driving of a liquid crystal display device, the method comprising:

a first step of processing RGB data outputted from the outside by a certain inversion method and outputting the data to a data driver at normal times;

a second step of checking whether at least one data among the RGB subpixel data has an on/off type data value;

a third step of checking whether the current input frame is a shutdown pattern frame or not on the basis of the result of checking; and a fourth step of, when the current input frame is a shutdown pattern frame as a result of checking, converting and outputting input RGB data by an inversion method causing no horizontal crosstalk, wherein the third step comprises:

checking whether at least one data among the input RGB data is inputted in a shutdown pattern and counting the number of data inputted in the shutdown pattern, and if the ratio of the number of data inputted in the shutdown pattern within one frame is more than 80% and there are more than three consecutive frames having the shutdown pattern, judging the current frame as a frame of a shutdown pattern, and wherein the fourth step comprises:

confirming that there is no more shutdown pattern frame inputted when the ratio of the number of shutdown patterns to all the data is less than 30%, and if it is judged that there is no more shutdown pattern frame inputted, outputting data of the original inversion driving method, and wherein the second step further comprises:

if the gray scale values of the RGB data range from 255 to 48, judging the gray scale values as turned-on data values, and if the gray scale values of the RGB data range from 15 to 0, judging the gray scale values as turned-off data values.

5. The method of claim 4, wherein the certain inversion method of the first step includes a vertical two dot and horizontal one dot inversion method and a vertical one dot and horizontal one dot inversion method.

* * * * *